United States Patent [19]

Rubin et al.

[11] Patent Number: 4,902,992

[45] Date of Patent: Feb. 20, 1990

[54] MILLIMETER-WAVE MULTIPLEXERS

[75] Inventors: David Rubin, San Diego; Kurt Reinke, Santa Barbara, both of Calif.

[73] Assignee: The United States of America as represented by the Secretary of the Navy, Washington, D.C.

[21] Appl. No.: 182,290

[22] Filed: Mar. 29, 1988

[51] Int. Cl.[4] ..... H01P 1/213

[52] U.S. Cl. ..... 333/126; 333/134; 333/204

[58] Field of Search ..... 333/110, 134, 126, 194, 333/204, 248

[56] References Cited

U.S. PATENT DOCUMENTS

| | | | |
|---|---|---|---|
| 3,121,847 | 2/1964 | Pakan | 333/126 |
| 4,029,902 | 6/1977 | Bell, Jr. | 333/110 |
| 4,168,479 | 9/1979 | Rubin | 333/126 |
| 4,210,881 | 7/1980 | Rubin | 333/110 |
| 4,433,314 | 2/1984 | Hislop et al. | 333/110 |
| 4,509,165 | 4/1985 | Tamura | 370/38 |

*Primary Examiner*—Salvatore Cangialosi

*Attorney, Agent, or Firm*—Harvey Fendelman; Thomas Glenn Keough

[57] ABSTRACT

A planar millimeter wave circuit for splitting a very wide input frequency band into three or more lesser bands utilizes bandpass filters exclusively. A triplexer is made by connecting the bandpass filters with coupled line equivalents fed by a conductor with a characteristic impedance the same as the input conductor to the filters and of an appropriate length so as to make the diplexer appear open or nearly open circuited over the adjacent frequency range of a third bandpass filter used in the triplexer or, alternatively, over the adjacent frequency range of a second diplexer connected so as to form a quadruplexer.

10 Claims, 2 Drawing Sheets

MILLIMETER-WAVE MULTIPLEXERS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of multiplexers and, more specifically, to the field of millimeter wave multiplexers constructed in the stripline, microstrip and suspended substrate media.

The most common method of multiplexing involves the utilization of a series of bandpass and bandstop filters connected as illustrated in FIG. 1. In FIG. 1 a triplexer 12 that is intended to operate in the 75 to 110 GHz band receives its input on input transmission line 14. The triplexer 12 is comprised of two bandpass filters 16 and 18 operating in the 75 to 98 and 75 to 86 GHz bands, respectively. A first bandstop filter 20 is connected between the input and bandpass filter 16 and a second bandstop filter 22 is connected between the bandpass filter 16 and 18. The bandstop filter 20 rejects signals between the 75 to 98 GHz band and therefore passes signals in the 98 to 110 GHz band. The bandstop filter 22 rejects signals in the 75 to 86 GHz band and therefore passes signals in the 76 to 98 GHz band. For a 75 to 110 GHz input signal, therefore, the output signal components in the 98 to 110 GHz band appear primarily on output 24. Output signals in the 76 to 98 GHz band appear primarily on output 26 and output signals in the 75 to 86 GHz band appear primarily on output 28. The filters 16, 18, 20 and 22 are generally designed so that at each junction 30 and 32 the susceptances of the bandpass and bandstop filters oppose and cancel over their respective frequency bands. Multiplexers of the form illustrated in prior art FIG. 1 are not found at the EHF band because lumped elements, i.e. inductors and capacitors, do not exist at those frequencies. Wide band commensurate line distributed filters have not been built in both bandpass and bandstop form.

A second type of multiplexer can be formed using bandpass filters without bandstop filters but requiring the use of 3dB hybrid couplers. One such example is illustrated in prior art FIG. 2. The triplexer 34 illustrated in FIG. 2 is comprised of three input 3dB couplers 36, 38 and 40, each of which feeds a pair of bandpass filters. Specifically, bandpass filters 42 and 44 pass filters in the frequency range $f_1$–$f_2$, bandpass filters 46 and 48 pass frequencies in the band $f_2$–$f_3$ and bandpass filters 50 and 52 pass frequencies in the range $f_3$–$f_4$ The outputs of each pair of bandpass filters are passed to another 3dB hybrid coupler, specifically, 54, 56 and 58 as illustrated. Briefly, this triplexer operates such that the input signal to 3dB hybrid coupler 36 is split at its output between the bandpass filters 42 and 44. The inputs to the bandpass filter 42 and 44 comprise one-half the power of the input signal to the 3dB coupler 36 and are 90 degrees out of phase with respect to each other. The second 3dB coupler 54 recombines the outputs of the bandpass filters 42 and 44 such that all of the power from the input signal to the 3dB coupler 36 within the frequency band $f_1$–$f_2$ appears recombined, in-phase on the one output terminal of the 3dB coupler 54. The loaded terminal of the 3dB coupler 54 has essentially no output signal since the signals from the bandpass filters 42 and 44 are cancelled at that terminal due to a 180 degree phase shift therebetween. The fourth port 60 of 3dB coupler 36 receives all power from the input signal except that which was passed through the 3dB coupler 36 to the bandpass filters 42 and 44. Therefore, the output on the unloaded terminal of 3dB coupler 56 comprises all signals within the frequency band $f_2$–$f_3$. Similarly, the output on the unloaded terminal of 3dB coupler 58 comprises all signals within the frequency band $f_3$–$f_4$. The bandwidth of the form of multiplexer illustrated in FIG. 2 is dependent on the directivity and isolation of the hybrid couplers used. While attempts have been made to fabricate triplexers of the form illustrated in FIG. 2 in the frequency range over the 75–110GHz bandwidth, these attempts have been futile due to the poor performance of 3dB quadrature couplers over such a large frequency band.

SUMMARY OF THE INVENTION

The present invention solves the problems associated with the types of prior art multiplexers illustrated in FIG. 1 and FIG. 2. This is accomplished by the design of the present invention which includes a triplexer comprising only three bandpass filters or alternatively, a quadruplexer comprising only four bandpass filters. In the triplexer implementation of the present invention, the input is essentially diplexed with one conductor arm attached to the input going to a first bandpass filter, e.g. in the 98–110 GHz bandwidth, and with the other conductor arm going to a second bandpass filter that comprises a diplexer operating, e.g. in the 75–98 GHz bandwidth. The bandpass filters of the present invention are connected in a manner which reduces interaction between each other. The bandpass filters are interconnected by lengths of transmission lines between a common junction and two bandpass filters to make each filter appear nearly open circuited to signals within the frequency band of the other filter. The lengths of line that can be added to the input of each bandpass filter in the present invention may be used to rotate the susceptance points on the outside of a Smith chart to make them appear almost open circuited over adjacent or largely separated bands. Optimization of lengths and impedances of these lines can often eliminate the need for the additional diplexing line. In the triplexer embodiment of the present invention, two bandpass filters in the diplexer portion are connected to the input junction through a transmission line which makes the entire diplexer appear as nearly open circuited as possible over the bandwidth of the third bandpass filter in the triplexer. The input section of the third bandpass filter is decoupled and optimized to make it appear as nearly open circuited as possible at the input junction for signals within the bandwidth of the diplexer.

In an alternate embodiment of the present invention the technique and concept of the present invention may be utilized to create a quadruplexer.

The filters used in the multiplexer of the present invention are all bandpass filters. No conjugately matched bandstop filters or wideband hybrid couplers are necessary in the present invention. Since a minimum number of filters are utilized in the present invention to pass the number of required frequency bands, circuit losses are minimized.

OBJECTS OF THE INVENTION

Accordingly, it is the primary object of the present invention to disclose a planar stripline means of splitting a very wide millimeter wave input band into three or more small bands or, conversely, to combine several smaller bands into one wideband.

It is a further object of the present invention to disclose a millimeter wave multiplexer that is comprised entirely of bandpass filters.

Another object of the present invention is to disclose a millimeter wave multiplexer that utilizes no 3dB couplers.

These and other objects of the invention will become more readily apparent from the ensuing specification when taken together with the drawings.

DESCRIPTION OF THE PREFERRED EMBODIMENT

Figure 1:
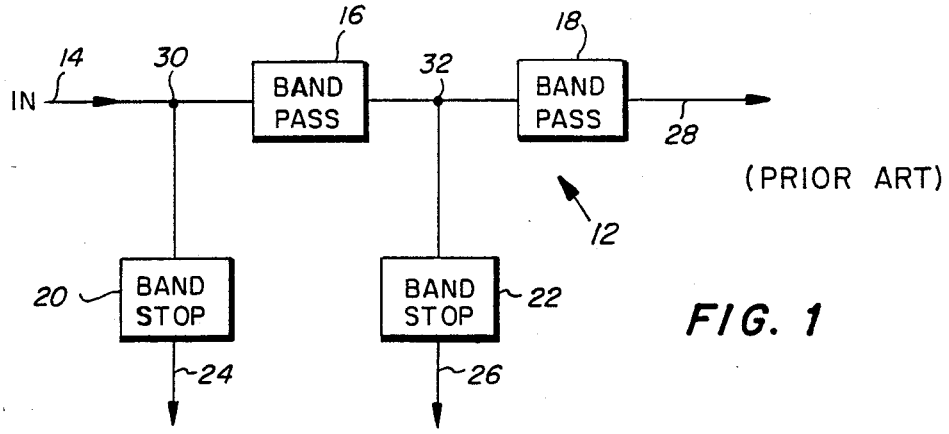
FIG. 1 is a schematic diagram of a prior art triplexer utilizing both bandpass and bandstop filters.
Figure 2:
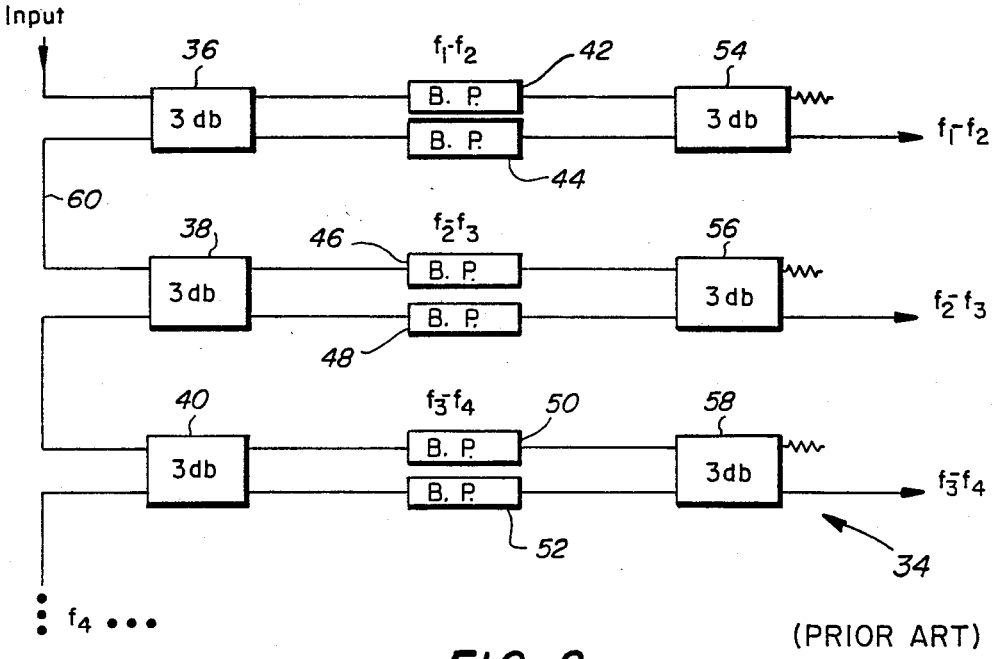
FIG. 2 is a schematic representation of a prior art triplexer that utilizes 3dB couplers.
Figure 3:
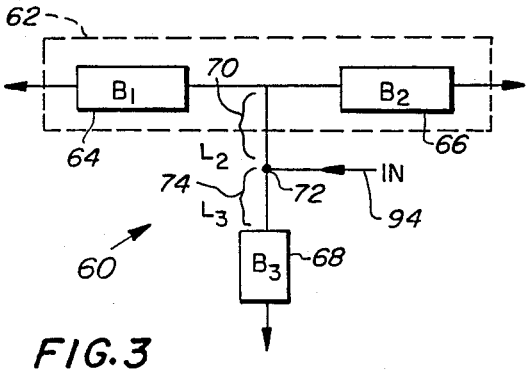
FIG. 3 is a schematic representation of a triplexer implementation of the present invention.

Referring to FIG. 3 the triplexer implementation of the present invention is illustrated. The triplexer 60 generally is comprised of a diplexer 62 which includes a first bandpass filter 64 and a second bandpass filter 66. The triplexer further includes a third bandpass filter 68 connected generally as illustrated in FIG. 3. The diplexer 62 with filters 64 and 66 are connected through transmission line 70 of length L2 and of characteristic impedance $Z_0$ to junction 72. The length L2 is the length that is necessary to make the diplexer 62 appear as nearly as possible as an open circuit over the adjacent frequency range of bandpass filter 68. Transmission line 74 connected between junction 72 and the input of bandpass filter 68 has a length L3 of transmission line having a characteristic impedance $Z_0$ which makes the impedance of bandpass filter 68 appear as nearly as possible as an open circuit at junction 72 over the frequency band of the diplexer 62. In the triplexer implementation illustrated in FIG. 3, the length L3 of transmission line 74 may not be required if the first coupled section of bandpass filter 68 is replaced by an equivalent distributed line or a coupled line equivalent as will be described below with respect to FIG. 5.

Figure 4:
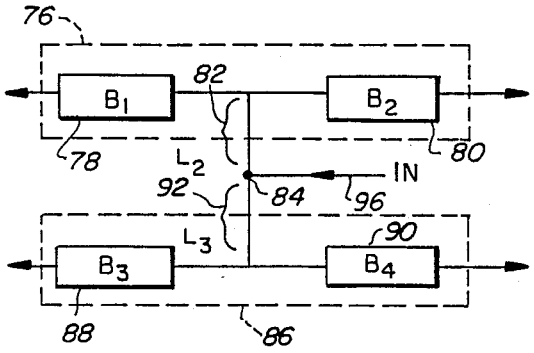
FIG. 4 is a schematic representation of a quadruplexer implementation of the present invention.

Referring to FIG. 4 a quadruplexer implementation of the present invention is schematically illustrated. In FIG. 4 a diplexer 76 with bandpass filters 78 and 80 is connected through the line length L2 of transmission line 82 to junction 84 in the same manner described above with respect to the triplexer illustrated in FIG. 3. In the quadruplexer implementation of the present invention a second diplexer 86 with bandpass filters 88 and 90 is connected through a transmission line 92 of length L3 and characteristic impedance $Z_0$. The length L3 of transmission line section 92 makes the impedance of diplexer 86 appear as nearly as possible as an open circuit at junction 84 over the frequency range of diplexer 76. The transmission line 82 of line length L2 likewise makes the diplexer 76 appear as nearly as possible as an open circuit to signals at frequencies within the bandpass of diplexer 86.

Referring to FIGS. 3 and 4 it can thus be appreciated that an input signal on either input line 94 to triplexer or input line 96 to the quadruplexer is split into its component frequency bands as determined by the passbands of the passband filters 64, 66 and 68 in the triplexer and 78, 80, 88 and 90 in the quadruplexer.

Figure 5:
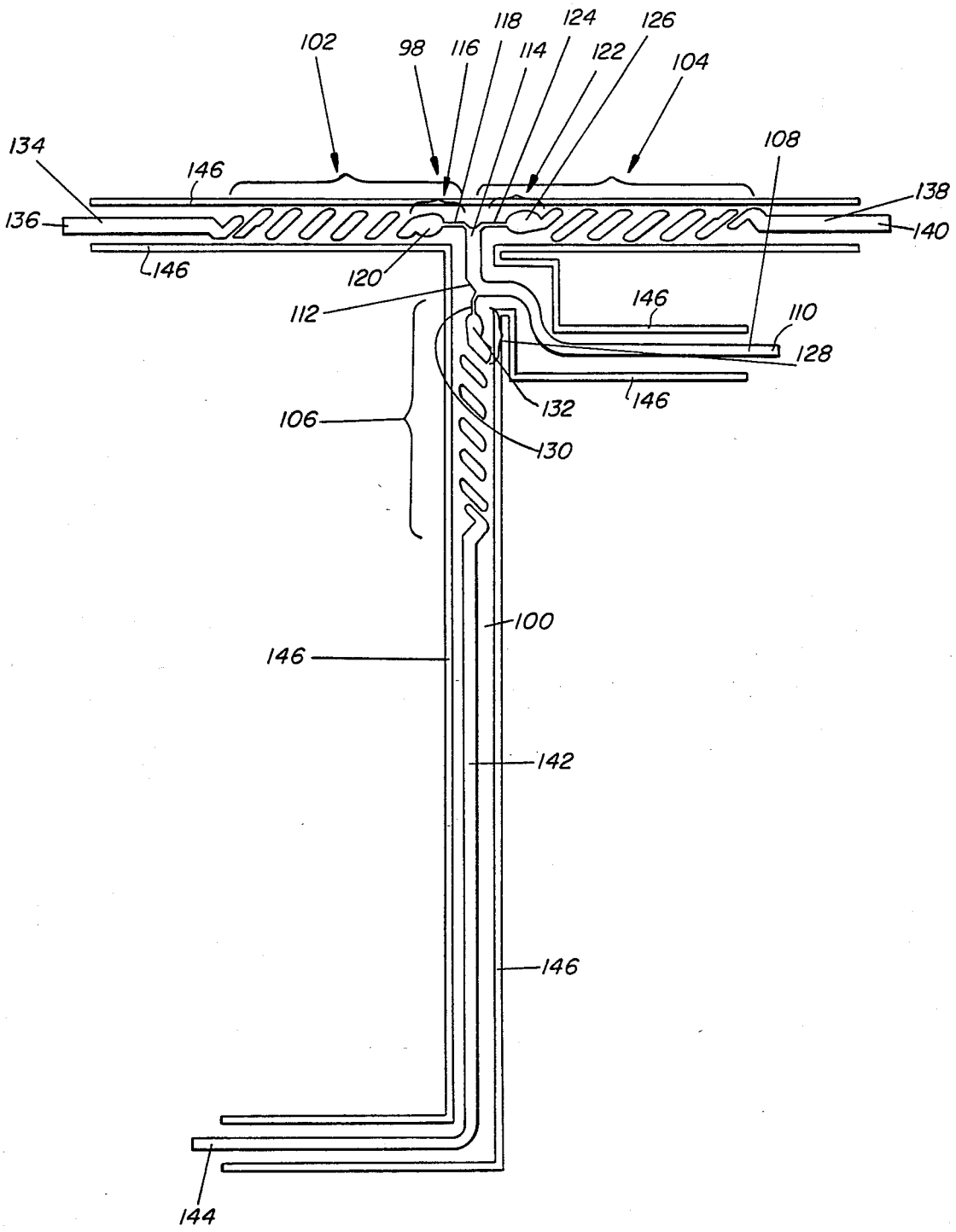
FIG. 5 is a top view of the triplexer circuit pattern in accordance with the present invention.

Referring now to FIG. 5 and by way of example, a circuit pattern suitable for implementation of the triplexer of the present invention is illustrated and will be described. The printed circuit of the triplexer 98 of the present invention is formed on a dielectric substrate 100 by suitable techniques such as photolithography as is well known. The triplexer is comprised of three passband filters each implemented as an edge coupled line filter. A detailed description of edge coupled line bandpass filters is given in the article by S. B. Cohn, "Parallel-Coupled Transmission-Line-Resonator Filters". IRE Trans. PGMTT, volume MTT-6, pp. 223–231 (April 1958). Edge coupled line passband filter 102 has a passband $P_1$ centered around the frequency $f_1$. Edge coupled line passband filter 104 has a passband $P_2$ centered around the frequency $f_2$. A third edge coupled line passband filter 106 has a passband $P_3$ centered around the frequency $f_3$.

The input to the triplexer is derived from input transmission line 108 which has a characteristic impedance $Z_0$. The input transmission line 108 may be fed from probe 110 which may extend into a waveguide (not shown). The input transmission line 108 is used to propagate electromagnetic energy to junction 112. Transmission line 114 of characteristic impedance $Z_0$ and line length L2 interconnects junction 112 to the diplexer comprised of passband filter 102 and passband filter 104. A coupled line equivalent 116 comprised of high impedance section 118 and low impedance section 120 replaces the first coupled line of the edge coupled filter 102 and interconnects the edge coupled filter 102 to the transmission line section 114. Similarly, coupled line equivalent 122 comprised of high impedance section 124 and low impedance section 126 replaces the first coupled line of edge coupled line filter 104 and serves to interconnect edge coupled passband filter 104 to transmission line segment 114. Similarly, coupled line equivalent 128 comprised of high impedance section 130 and low impedance section 132 replaces the first coupled line of edge coupled filter 106 and interconnects junction 112 with edge coupled filter 106.

The output of passband filter 102 is derived via transmission line 134 which terminates in probe 136 which may extend into a waveguide (not shown) and similarly, the output of passband filter 104 is derived via transmission line 138 via probe 140 which may also extend into a waveguide (not shown). Likewise, the output of passband filter 106 is taken from transmission line 142 via probe 144 which may also extend into a waveguide (not shown) as would be readily understood by one of ordinary skill in this art. The perimeter 146 illustrated in FIG. 5 represents the ridges of a below cut-off waveguide channel within which the triplexer of FIG. 5 may be enclosed as would be readily understood by one of ordinary skill in this art.

By way of example, the passband filter 102 may be an 86–98 GHz passband filter, the passband filter 104 may be a 75–86 GHz passband filter and the passband filter 106 may be a 98–110 passband filter where the input signal is in the frequency ranges of 75–110 GHz. Coupled line equivalent circuits 116 and 122 are designed such that the diplexer filters 102 and 104 appear nearly open circuited within each other's passband. The additional line 114 of $Z_0$ impedance causes the diplexer to appear nearly open circuited at junction 112 the passband frequencies of filter 106. Equivalent coupled circuit 128 is designed such that passband filter 106 looks as nearly as possible as an open circuit at juncture 112 to signals within the 102, 104 diplexer bandwidth.

It should be readily understood to those of ordinary skill in this art that the planar circuit pattern illustrated in FIG. 5 can be implemented in either stripline, microstrip or suspended substrate media.

Obviously, many modifications and variations of the present invention are possible in the light of the above teachings. It is therefore to be understood that within the scope of the appended claims the invention may be practiced otherwise than as specifically described.

We claim:

1. A millimeter wave triplexer comprising:

a dielectric substrate having first and second surfaces;

a first bandpass filter disposed on said first surface and having a passband $P_1$ centered around the frequency $f_1$;

a second bandpass filter disposed on said first surface and having a passband $P_2$ centered around the frequency $f_2$;

first conductor means disposed on said first surface for interconnecting said first and second bandpass filters;

a third bandpass filter disposed on said first surface and having a passband $P_3$ centered around the frequency $f_3$;

an input conductor disposed on said first surface;

second conductor means disposed on said first surface for interconnecting said input conductor with said first conductor means at an intersection, the impedance at said intersection towards said first conductor being approximately an open circuit to signals within said frequency band $P_3$; and third conductor means connected at said intersection to said input conductor and to said second conductor means and also being connected to said third bandpass filter.

2. The triplexer of claim 1 wherein:

said first, second and third bandpass filters are edge coupled line filters.

3. The triplexer of claim 1 wherein:

said first and third conductor means are coupled line equivalents.

4. The triplexer of claim 3 wherein said coupled line equivalents each comprise a low impedance conductor connected to a high impedance conductor, and wherein the impedance of said high impedance conductor is higher than the impedance of said low impedance conductor.

5. The triplexer of claim 4 wherein:

each said high impedance conductor is wider than said input conductor.

6. The triplexer of claim 1 wherein:

said passband $P_1$ is approximately 86–98 GHz said passband $P_2$ is approximately 75–86 GHz; and said passband $P_3$ is approximately 98–110 GHz.

7. The triplexer of claim 1 wherein:

said first, second and third bandpass filters, said first, second and third conductor means and said input conductor are positioned within a below cutoff waveguide channel.

8. The triplexer of claim 1 wherein:

the characteristic impedance of said second conductor means is substantially identical to the characteristic impedance of said input conductor.

9. A millimeter wave triplexer comprising:

first, second and third bandpass filters;

first and second interconnecting transmission lines connected respectively between said first and second and said second and third bandpass filters, said first and second interconnecting transmission lines being of specific lengths so as to cause each of said first, second and third passband filters to appear approximately as an open circuit to signals within the passband of the other two filters.

10. A millimeter wave quadruplexer comprising:

first, second, third and fourth bandpass filters;

first, second and third interconnecting transmission lines connected respectively between said first and second, second and third and third and fourth bandpass filters, said first, second and third interconnecting transmission lines each being of a specific length so as to cause each of said first, second, third and fourth passband filters to appear approximately as an open circuit to signals within the passband of the other three passband filters.

* * * * *